US006591530B1

(12) United States Patent
Liao

(10) Patent No.: US 6,591,530 B1
(45) Date of Patent: Jul. 15, 2003

(54) DYNAMIC PICTURE SET

(76) Inventor: Ching-Shin Liao, No. 2, Lane 51, Chung-Mei St., Taichung (TW)

( * ) Notice: Subject to any disclaimer, the term of this patent is extended or adjusted under 35 U.S.C. 154(b) by 0 days.

(21) Appl. No.: 10/067,250

(22) Filed: Feb. 7, 2002

(51) Int. Cl.[7] ..... A47G 1/06
(52) U.S. Cl. ..... 40/714; 40/442
(58) Field of Search ..... 40/452, 448, 714, 40/427, 442

(56) References Cited

U.S. PATENT DOCUMENTS 2,522,812 A * 9/1950 Bonnet ..... 40/427
5,657,563 A * 8/1997 Lane ..... 40/714
5,819,454 A * 10/1998 Rosenitsch ..... 40/452
6,430,858 B1 * 8/2002 Andre ..... 40/714

* cited by examiner

*Primary Examiner*—Gary Hoge
(74) *Attorney, Agent, or Firm*—Birch, Stewart, Kolasch & Birch, LLP

(57) ABSTRACT

A dynamic picture set for displaying pictures and decorative characters and patterns with a dynamic visual effect consists of a picture sheet, a transparent body and a back plate located behind the picture sheet, and a frame located in front of the picture sheet. The picture sheet has a rear side adhering to decorative characters or a picture and a first opening formed at a lower section. The back plate has a transparent jutting section to wedge in the first opening. The jutting section has peripheral rims surrounded by a layer of cold light strip and a front or a rear side carved with selected characters or patterns. The transparent body has a plurality of indented refractive patterns formed on a rear or a front side thereof. The frame has a display device located at one corner to display time or art temperature.

2 Claims, 2 Drawing Sheets

DYNAMIC PICTURE SET

FIELD OF THE INVENTION

The present invention relates to decorative pictures and particularly picture sets that are capable of generating colored and dynamic lighting patterns.

BACKGROUND OF THE INVENTION

The common pictures being hung on walls are mostly static types. Even those with three-dimensional effect also are static nature. Their appeal diminishes rapidly when hung for a period of time. This mainly results from lack of lighting effect on the static pictures. Hence they look dull and become not stimulating after a period of time. The static nature makes the pictures plain and not distinctive, and does not have lasting appeal.

SUMMARY OF THE INVENTION

In view of the foregoing disadvantages, the primary object of the invention is to provide an improved picture set that has dynamic visual effect to enhance its appeal. The dynamic decorative picture set according to the invention has colored character strings made of a cold light material, such as known electroluminescent (EL) material, which can radiate light when electrified. The decorative picture, character strings or patterns can be lighted in a gradual and running fashion to increase its amusing and appealing effects.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
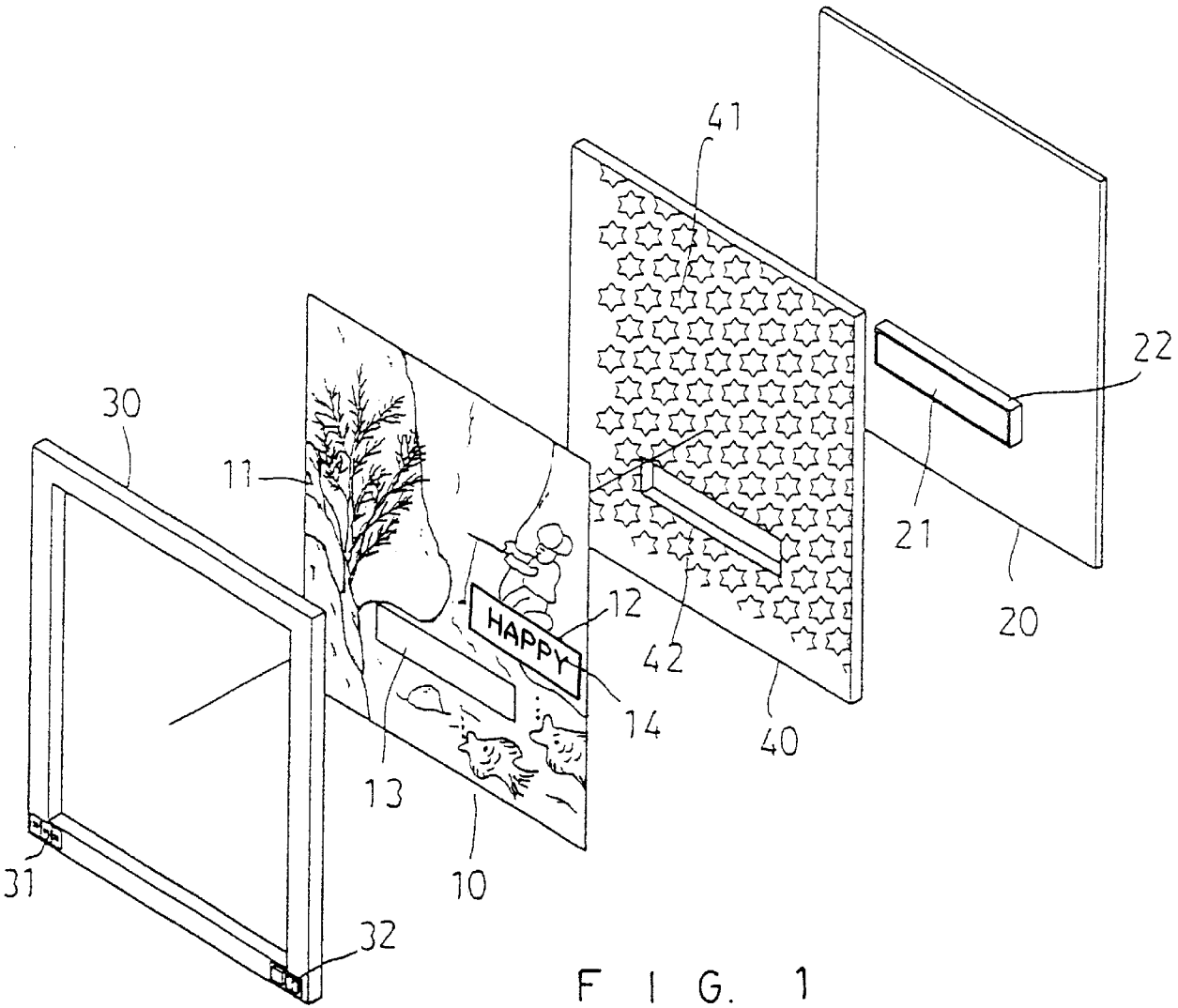
FIG. 1 is an exploded view of an embodiment of the invention.

Referring to FIG. 1 for an embodiment of the invention, the picture set according to the invention mainly includes a light penetrating picture sheet 10 which has a decorative picture 11 located on a front side thereof. The decorative picture 11 is printed or coated on a glossy and reflective paper. On the rear side of the picture sheet 10, there is a line frame 12 made of a cold light material. Line frame 12 is in the form of an adornment plate. In the line frame 12, there is a character string 14 (such as HAPPY, for example) or a phrase to convey desired purpose. On a lower section of the picture sheet 10, there is a first rectangular opening 13. The character string 14 may also be replaced by a pattern.

Behind the picture sheet 10, there is a transparent body 40 which has indented refractive patterns 41 formed on the rear (or front) side for generating refractive effect when projecting with light thereby to augment light radiating effect of the decorative picture 11 on the picture sheet 10. The transparent body 40 has a second rectangular opening 42 at a lower section thereof.

There is a rectangular back plate 20 located behind the picture sheet 10 and made of an opaque material with a jutting section 21 formed on the front surface matching the first rectangular opening 13 of the picture sheet 10 and the second rectangular opening 42 of the transparent body 40. The jutting section 21 is transparent (made of glass or acrylic) and has peripheral rims surrounded by a strip 23 formed from a layer of cold light material or LED apparatus. The rear (or front) side of the jutting section 21 may be carved or embossed with selected characters or patterns (not shown in the drawing).

There is a frame 30 located in front of the picture sheet 10. The frame 30 has a display device 31 located at one side for indicating date (year, month, day) or temperature, and a switch 32 wiring to the line frame 12 and character string 14 to form a circuit for generating light.

Figure 3:
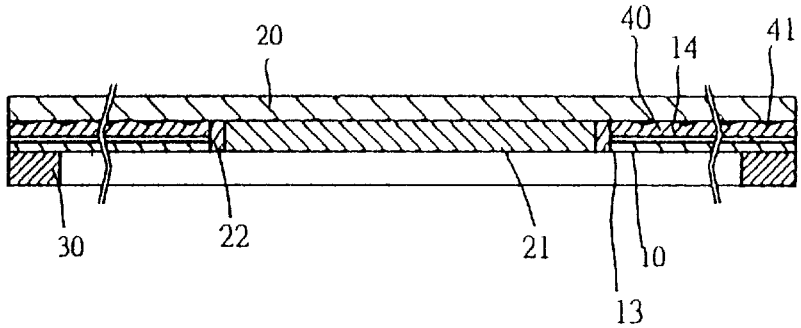
FIG. 3 is a cross section taken along line 3—3 in FIG. 2.

Referring to FIGS. 1 and 3, after assembled, the jutting section 21 of the back plate 20 is wedged in the second rectangular opening 42 of the transparent body 40 and the first rectangular opening 13 of the picture sheet 10. The line frame 12 and character string 14 are sandwiched between the picture sheet 10 and transparent body 40. The frame 30 is attached to the front side of the picture sheet 10 to become a complete picture set.

Figure 2:
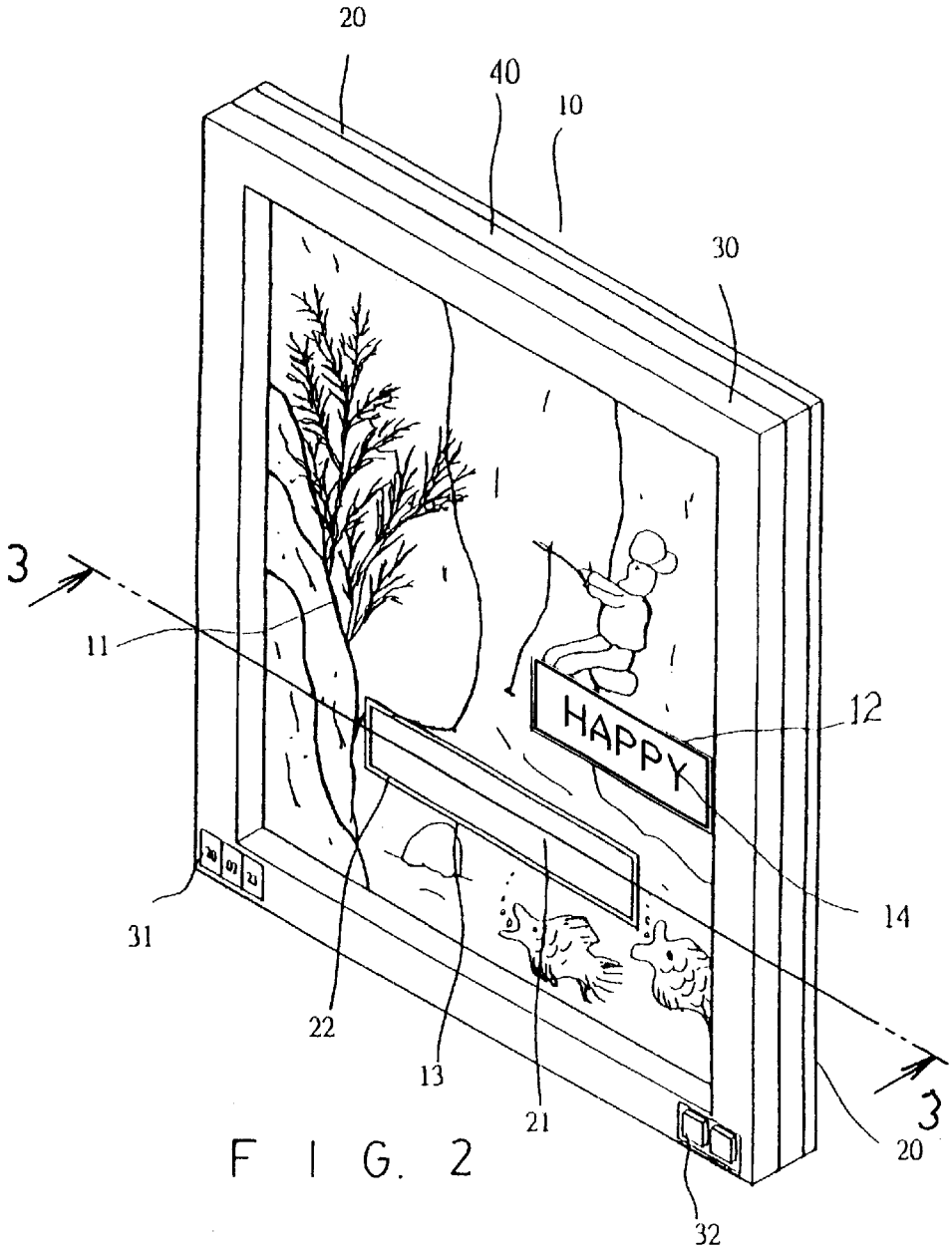
FIG. 2 is a perspective view of an embodiment of the invention.

Referring to FIG. 2, when the switch 32 is activated, the line frame 12 and the character string 14 will be energized to generate light of various colors. Furthermore, the switch 32 may also control lighting variations of the line frame 12 such as progressing in one direction to produce a flicker running light effect. The character string 14 may also radiate light sequentially. With the light radiation of the line frame 12 and the character string 14 illuminating the picture sheet 10 and the decorative picture 11, different hues and tints of light will be shown on the decorative picture 11 and the line frame 12 and the character string 14 with different levels to add amusing and entertainment effect. When the switch 32 is turned off, the line frame 12 and the character string 14 will stop radiating light and the decorative picture 11 on the picture sheet 10 will be shown as usual to save electric energy. Moreover, the cold light strip 22 or LED apparatus surrounding the jutting section 21 of the back plate 20 can generate more colorful light to create additional visual effect. The display device 31 on the lower side of the frame 30 can function as a time piece to indicate year, month and date. A thermometer may also be included as desired (not shown in the drawings).

Comparing with conventional decorative pictures, the invention offers a number of advantages. First, the line frame 12 and the character string 14 can generate colorful light running effect, and the indented refractive patterns 41 formed on the transparent body 40 behind the picture sheet 10 can generate refractive effect to augment light illumination effect. The switch 32 can be turned off to allow the decorative picture 11 on the picture sheet 10 displaying without consuming electric energy, and can be turned on to allow the line frame 12 and the character string 14 generating progressive and running light effect, thus offers a switch function to save electric energy and trigger dynamic amusing effect whenever desired. Second, the cold light strip 22 or LED apparatus surrounding the jutting section 21 located at the lower section of the picture sheet 10 can high light the surrounding characters and patterns, and create more distinctive visual effect. The frame 30 further has the display device 31 to display year, month and day.

What is claimed is:

1. A dynamic picture set, comprising:

a picture sheet made of a light penetrating thin plate having a glossy and colored decorative picture located at a front side thereof, at least one line frame and a character string adhered to a rear side of the picture sheet, the line frame and the character string being made of a cold light material and wired through a circuit to a switch and a power source, the decorative picture having a first opening formed at a selected location;

a transparent body located behind the picture sheet having a plurality of indented refractive patterns selectively formed on a rear or a front side thereof and a second opening formed at a lower section thereof; and a back plate made of an opaque material and located behind the picture sheet having a jutting section matching the first opening of the picture sheet and the second opening of the transparent body, the jutting section being transparent and having peripheral rims surrounded by a strip formed from a layer of cold light material and a side for carving with selected characters or patterns.

2. The dynamic picture set of claim 1 further having a frame located in front of the picture sheet, the frame having a display device located on a front side at a selected location thereof for displaying time of year, month, day or a thermometer.

* * * * *